US006067760A

United States Patent [19]

Nowell

[11] Patent Number: 6,067,760

[45] Date of Patent: May 30, 2000

[54] CORNER BRACKET FOR DOORS AND WINDOWS

[75] Inventor: Jeffrey A. Nowell, Hudson, Ohio

[73] Assignee: Patio Enclosures, Inc., Macedonia, Ohio

[21] Appl. No.: 09/039,037

[22] Filed: Mar. 13, 1998

Related U.S. Application Data

[63] Continuation-in-part of application No. 29/082,551, Jan. 26, 1998, Pat. No. Des. 411,018.

[51] Int. Cl.[7] ..... E04B 1/00

[52] U.S. Cl. ..... 52/204.57; 52/204.58; 52/656.5; 52/656.9; 403/231

[58] Field of Search ..... 52/204.57, 204.58, 52/656.1, 656.2, 656.4, 656.5, 656.6, 656.7, 656.9; 312/265.1, 265.4; 403/231, 363

[56] References Cited

U.S. PATENT DOCUMENTS

| | | | |
|---|---|---|---|
| D. 288,244 | 2/1987 | Schmidt . | |
| D. 411,018 | 6/1999 | Nowell | D25/61 |
| 1,852,866 | 4/1932 | Weitzel . | |
| 3,131,793 | 5/1964 | Bohn . | |
| 3,784,043 | 1/1974 | Presnick . | |
| 4,011,706 | 3/1977 | Dupree | 403/231 |
| 4,037,378 | 7/1977 | Collins et al. . | |
| 4,145,150 | 3/1979 | Rafeld . | |
| 4,164,105 | 8/1979 | Herbst et al. . | |
| 4,205,486 | 6/1980 | Guarnacci | 403/231 X |
| 4,303,289 | 12/1981 | Hardy . | |
| 4,502,260 | 3/1985 | Machler | 52/656.7 X |
| 4,570,406 | 2/1986 | DiFazio . | |
| 5,105,581 | 4/1992 | Slocomb, Jr. . | |
| 5,473,853 | 12/1995 | Guillemet et al. | 52/656.9 X |
| 5,870,868 | 2/1999 | Kita et al. | 403/231 X |

FOREIGN PATENT DOCUMENTS

| | | | |
|---|---|---|---|
| 7610404 | of 0000 | Netherlands . | |
| 2 161 193 | of 0000 | United Kingdom . | |
| 2212879 | 8/1989 | United Kingdom | 403/231 |

*Primary Examiner*—Richard Chilcot
*Attorney, Agent, or Firm*—Fay, Sharpe, Fagan, Minnich & McKee, LLP

[57] ABSTRACT

A corner bracket used with a window or sliding glass door assembly to form a corner joint connecting frame members together which hold the glass and weather insulation in place. The corner bracket includes a body which has a front side and a back side connected by a connecting wall. The corner body includes a first end and a second end, where the second end is oriented approximately normal to the first end. The first and second ends include a pair of channels, a pair of L-shaped members spaced from the channels, and a finger extending from the connecting wall. The corner can also include a groove portion which engages a securing wall for the window. The corner can also include a protrusion which engages a weather insulation strip. The channels are detachably received by slots in a frame member. The L-shaped members and the finger are detachably received by openings in the frame member.

27 Claims, 7 Drawing Sheets

A
D
D
C
C
B
E

CORNER BRACKET FOR DOORS AND WINDOWS

This application is a continuation-in-part of Application Ser. No. 29/082,551, filed on Jan. 26, 1998 now Design Pat. Des. 411,018.

BACKGROUND OF THE INVENTION

The present invention relates generally to connecting members for elongated structural components. More particularly, it relates to an improved corner bracket for use with door and window assemblies.

Framed window panels and sliding glass door assemblies are commonly made of four elongated frame members which are connected together at their adjacent ends by corner brackets. Frame members are commonly formed as hollow, rectangular shaped tubes which are typically made either from extruded aluminum or rolled sheet metal. The ends of the frame members are interconnected by corner brackets which generally comprise a pair of legs which extend outwardly from a corner body. The legs are inserted into the open ends of the frame members and are staked or locked into position.

A problem with known corner brackets made of metal is that thermal efficiency is lost as the corner brackets conduct heat too readily. Another problem with known corner brackets is that those made of aluminum are not structurally strong. Still another problem with existing corner brackets is that they do not have protrusions in the form of L-shaped members, channels, and fingers which can be detachably received in suitably shaped openings and slots in associated frame members.

Corner brackets which interconnect frame elements for windows and doors have been known for some time. One known device is shown in U.S. Pat. No. 1,852,866. This device is a corner brace for a window screen. A disadvantage of this corner brace is that is does not have fingers or L-shaped members detachably received in openings in a frame member.

Another device is disclosed in U.S. Pat. No. 4,145,150. This device is an angular corner piece for connecting profiled frame members of insulating glass. A disadvantage of this corner piece is that it does not have channels, fingers, or L-shaped members detachably received in openings in a frame member.

Another known device is disclosed in U.S. Pat. No. 4,164,105. This device includes a corner bracket which has prongs which mate with lower frame channels. A disadvantage of this device is that it requires an additional part, a tee-member, to secure a flexible film to the corner brackets and the frame members. Another disadvantage of this device is that the corner bracket does not include L-shaped members or channels detachably received in openings in the frame members.

Another known device is disclosed in U.S. Pat. No. 4,303,289. This device is a connecting member to interconnect elongated structural components. The connecting members include projecting spigot members to engage openings in the structural components. A disadvantage of this device is that it does not have channels detachably received in openings in the structural components.

Another known device is disclosed in U.S. Pat. No. 4,570,406. This device is a corner connector key which connects frame members together to form a corner. A disadvantage of this corner connector key is that it does not have fingers or L-shaped members detachably received in openings in the frame members.

Another known device is disclosed in U.S. Pat. No. 5,105,581. This device is a window frame which is secured together by utilization of corner key pieces. A disadvantage of this device is that the corner key pieces do not have L-shaped members, channels or fingers detachably received in openings in the window frame. Another disadvantage of this device is that the corner key pieces are permanently secured by ultrasound welding, which is time-consuming and permanent, making replacement of a window in the frame difficult.

Accordingly, it has been considered desirable to develop a new and improved corner bracket for a door or window which would overcome the foregoing difficulties and others while providing better and more advantageous overall results.

BRIEF SUMMARY OF THE INVENTION

The present invention relates to a corner bracket for use with frame members to form a corner joint.

More specifically, the corner bracket may be used with a window or sliding glass door assembly to form a corner joint connecting frame members together which hold glass or weather insulation in place.

In a preferred embodiment, the corner bracket comprises a body which has a front side, a back side and a connecting wall extending therebetween. The body includes a first end and a second end, where the second end is approximately normal, or at a 90 degree angle to the first end.

The first end and the second end may each be comprised of a pair of spaced channels which are so oriented as to face each other. These channels engage associated slots of a frame member. The channels extend from the front side and the back side of the body. The channels include first and second side walls and a base wall connecting the first and second side walls.

The first and second end may each be further comprised of a pair of spaced L-shaped members which are oriented as to face each other. The L-shaped members extend from the front side and the back side of the body and are spaced from the pair of channels. The L-shaped members engage openings in an associated frame member.

The first and second end may be also comprised of a finger which extends from the connecting wall and engages a stepped opening in an associated frame member.

If desired, the connecting surface of the corner bracket can further include a groove portion which engages an associated securing wall for a window.

Further, the front side and the back side of the corner bracket can comprise first, second and third abutment surfaces located on outside surfaces of L-shaped members and the base walls and side walls of the channels. The abutment surfaces abut an end surface of the associated frame member.

The corner bracket can also include a third channel which extends below the connecting wall of the body and is substantially perpendicular to the channels.

The first end and the second end can also include a protrusion which extends from the front side of the corner. The protrusion engages a front wall of the associated frame member.

The channels of the corner bracket can further include one or more ribs which engage a wall of the associated frame member.

The finger of the corner bracket can further include an aperture for accommodating an associated fastener.

One advantage of the present invention is the provision of a corner bracket made of a relatively non-conducting material and having several protrusions extending from each of a first end and a second end.

Another advantage of the present invention is the provision of a corner bracket having a pair of spaced channels which are oriented to face each other and engage slots in a frame member.

Still another advantage of the present invention is the provision of a corner bracket having a pair of spaced L-shaped members which are oriented to face each other and engage openings in a frame member.

Yet another advantage of the present invention is the provision of a corner bracket having a third channel which is oriented substantially perpendicular to a spaced pair of channels.

A further advantage of the present invention is the provision of a corner bracket having a series of spaced protrusions which extend from each of a first end and a second end and engage respective elongated frame members to form doors or windows.

Still other benefits and advantages of the present invention will become apparent to those skilled in the art upon a reading and understanding of the following detailed specification.

BRIEF DESCRIPTION OF THE DRAWINGS

The invention will take form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figures 1, 2, 4:
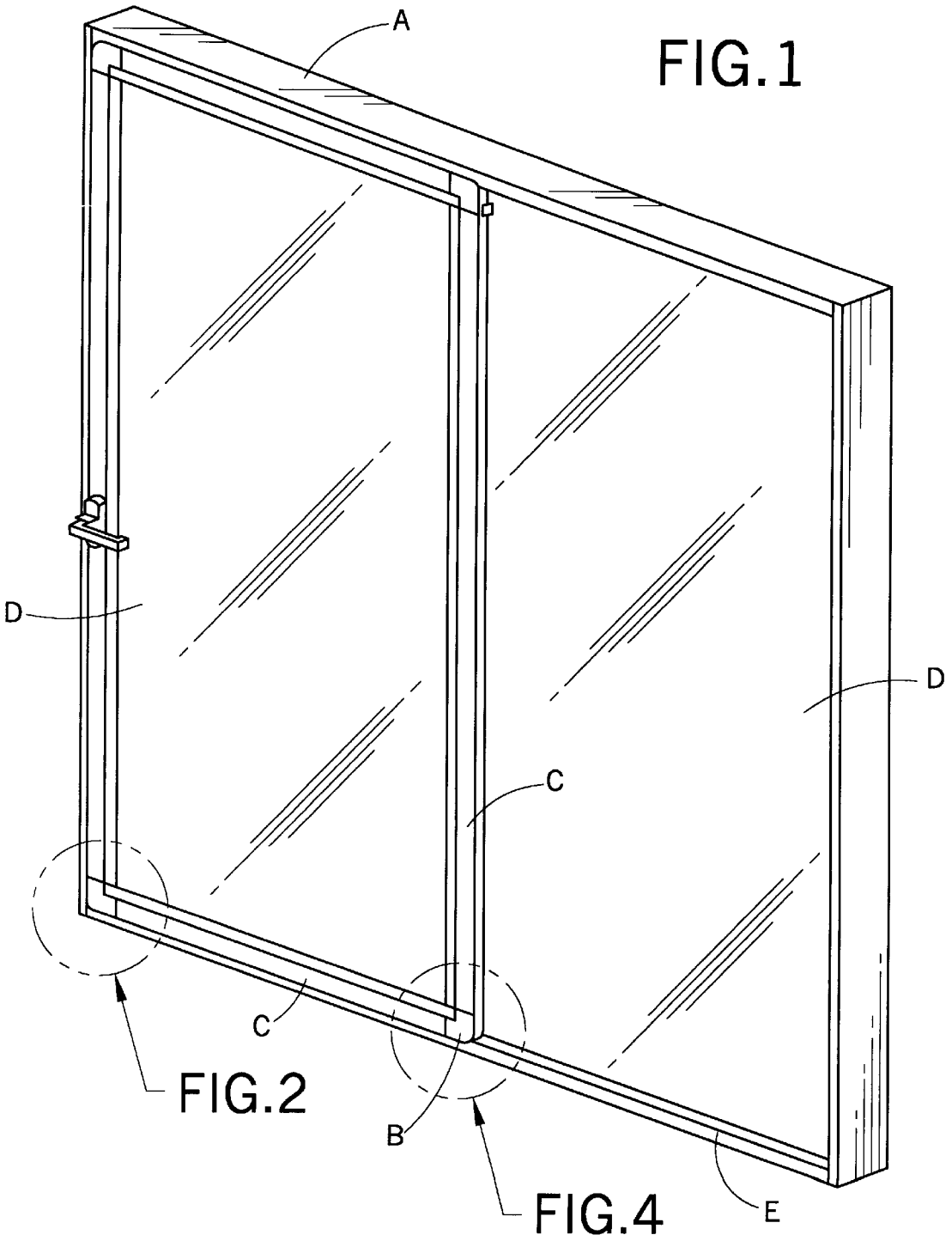
FIG. 1 is a perspective view of a sliding glass door assembly including a corner bracket in accordance with a preferred embodiment of the present invention.
FIG. 2 is an enlarged perspective view in cross section of a corner assembly of the door assembly shown in FIG. 1.
FIG. 4 is an enlarged perspective view of the corner assembly and a cross section of the door assembly of FIG. 1.
Figure 2:
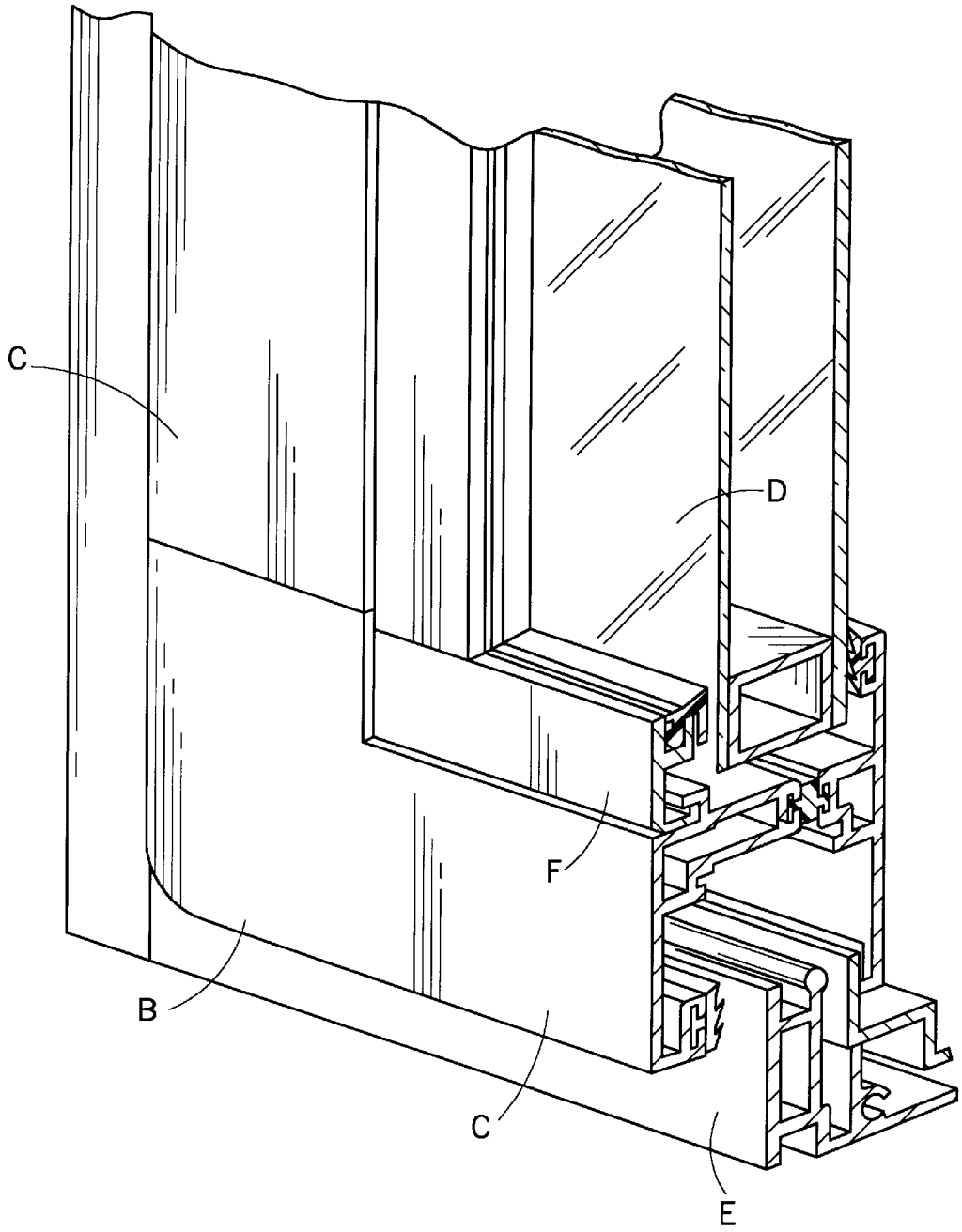

Referring now to the drawings, wherein the showings are for purposes of illustrating a preferred embodiment of this invention only and not for purposes of limiting same, FIG. 1 shows a sliding glass door assembly A which includes a corner bracket B in accordance with a preferred embodiment of the present invention, a frame member C, a window D, and a window or door track E.

With reference now to FIG. 2, a cross section of the frame member C, the window or door track E and a securing wall F for the window D is shown. FIG. 4 also shows the corner bracket B and frame member C assembly with a window D engaging the window or door track E, which is shown in cross section.

Figure 3:
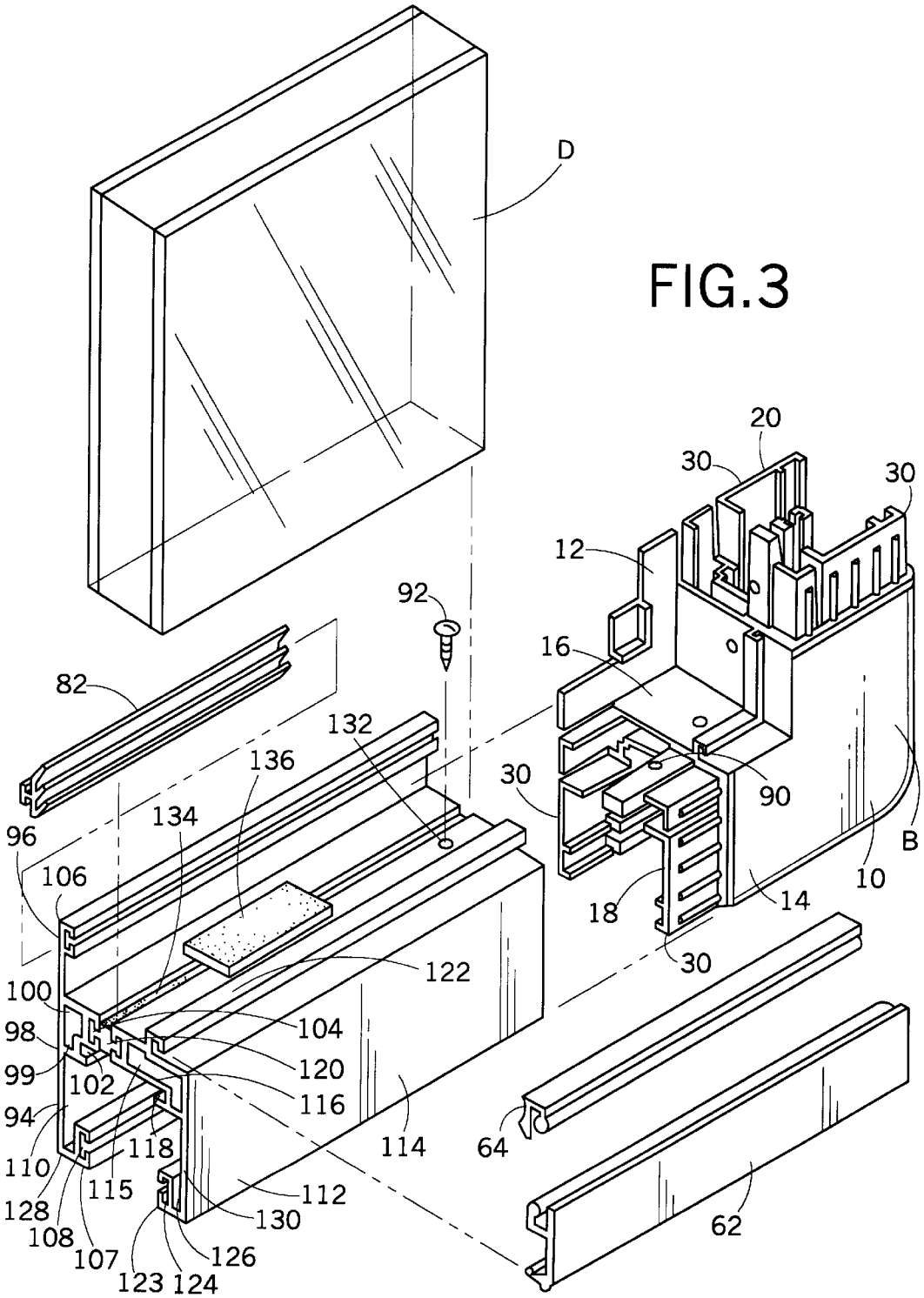
FIG. 3 is an exploded perspective view of a corner assembly of FIG. 1 including a frame member and a corner bracket.
Figure 4:
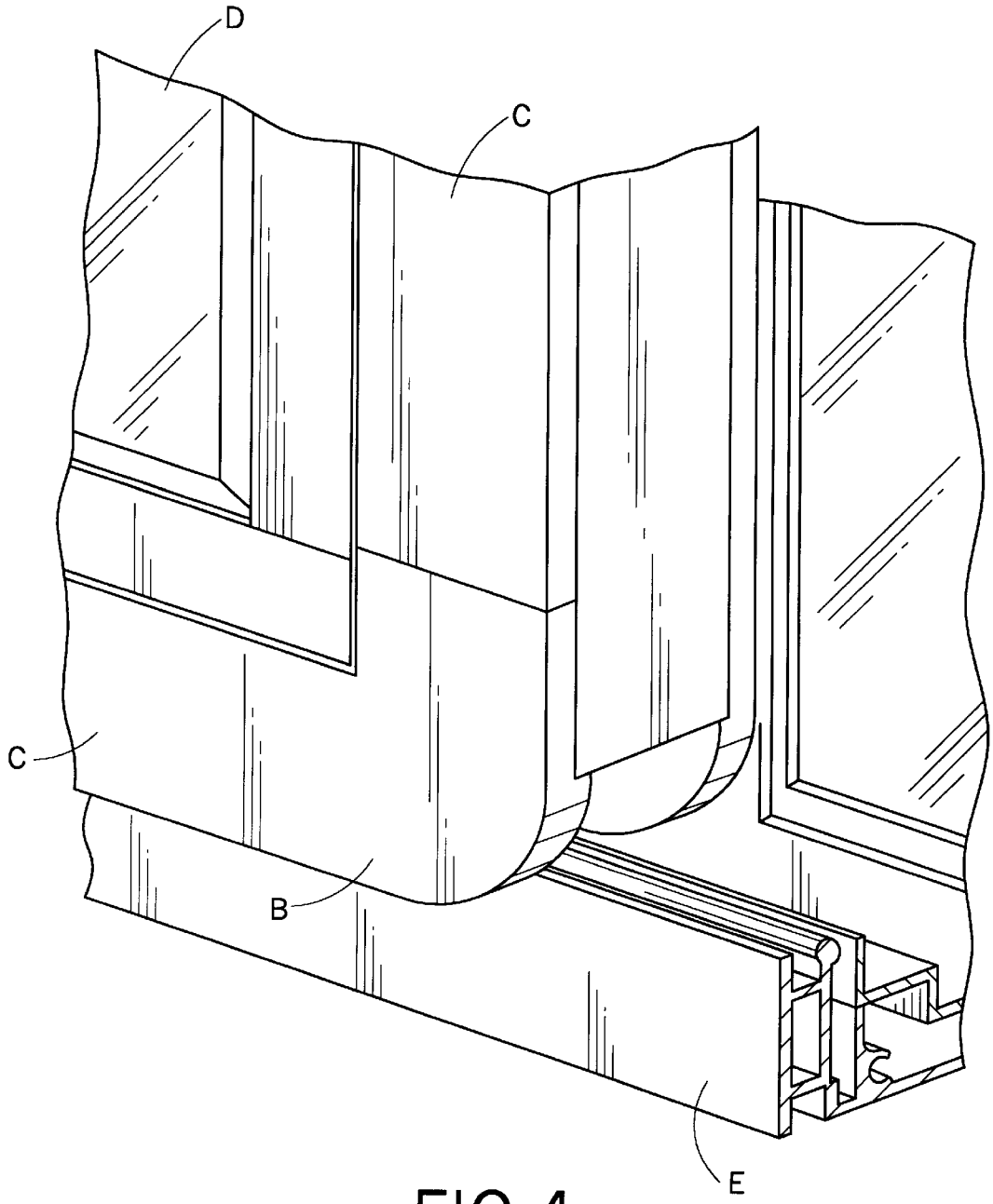

With reference now to FIG. 3, the corner bracket B includes a body 10 which has a front side 12 and a back side 14. The body 10 can be a one piece member fabricated from a plastic material so as to reduce heat conduction through the body. The plastic body can be made from a 20% glass filled vinyl and have the same coefficient of thermal expansion as aluminum. The plastic body also increases the structural strength of the corner body 10 by as much as 40% over previous corner bracket designs.

The front side 12 and the back side 14 are connected together by a connecting wall 16. The body 10 further includes a first end 18 and a second end 20, where the second end 20 is oriented approximately normal to the first end 18 and is symmetrical to the first end 18.

Figure 6:
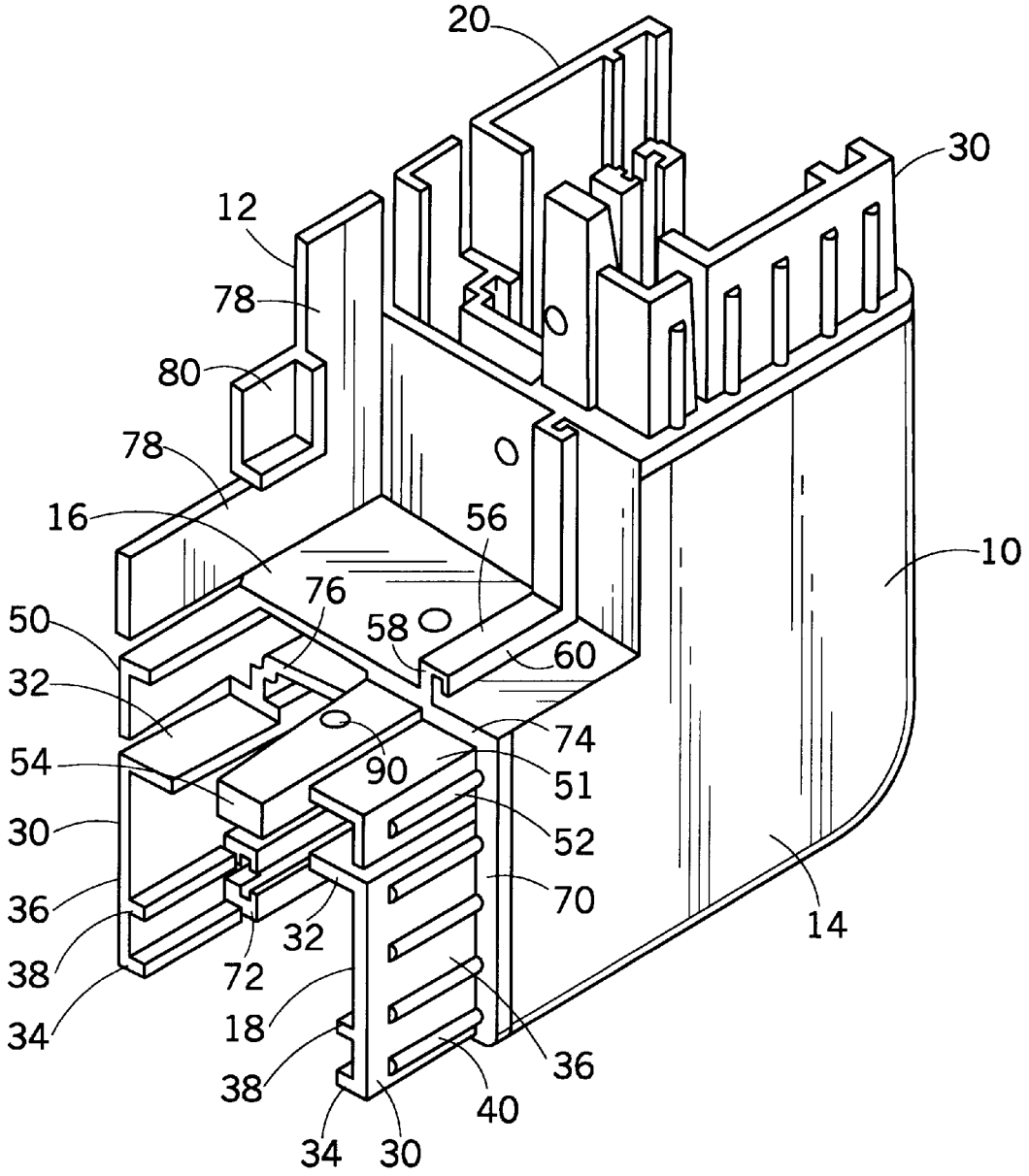
FIG. 6 is a perspective view of the corner bracket.

The first end 18 and the second end 20 each include a pair of spaced apart channels 30. Referring now to FIG. 6, the channels 30 include a first side wall 32, a second side wall 34, and a base wall 36 connecting the first side wall 32 to the second side wall 34. The channels 30 can also include a flange 38 disposed on the base wall 36 and located between the first side wall 32 and the second side wall 34. The channels 30 can also have ribs 40 extending away from the outside surface of the base wall 36.

The first end 18 and the second end 20 can further include a pair of spaced apart L-shaped members 50 and 51. The L-shaped members 50 and 51 extend from the front side 12 and the back side 14 of the body 10 and are spaced from the channels 30. If desired, the L-shaped members 50, 51 may each also include a rib 52.

The first end 18 and the second end 20 can also include a finger 54, which extends from the connecting wall 16.

Located on the connecting wall 16 is a groove portion 56, which is defined by an arm 58 and a flange 60 extending from the arm 58. Referring again to FIG. 3, the groove portion 56 engages a securing wall 62, which is used to secure the window D in place. A weather insulation strip 64 attaches to the securing member 62 to provide insulation around the window D.

Figure 8:
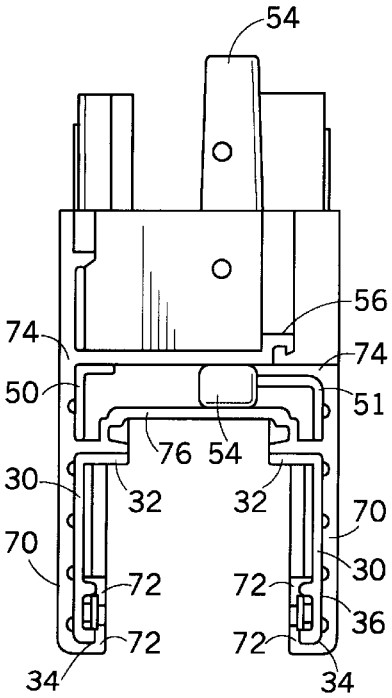
FIG. 8 is a front elevational view of the corner bracket.

Referring now to FIG. 8, the front side 12 and the back side 14 can further include first, second and third abutment surfaces 70, 72, 74. The first abutment surface 70 is located on an outside surface of the base wall 36. The second abutment surface 72 is located on at least one of the first side walls 32 and the second side walls 34 of the channels 30. The third abutment surface 74 is located on an outside surface of the L-shaped members 50, 51.

The first end 18 and the second end 20 can further include a third channel 76 which extends below the connecting wall 16 and is oriented substantially perpendicular to the channels 30. The third channel 76 receives the window or door track E.

Preferably, the first end 18 and the second end 20 can further include a protrusion 78 which extends from the front side 12. The protrusion 78 can include a square recess 80 which engages a weather insulation strip 82.

The finger 54 can include an aperture 90 which accommodates a fastener 92, shown in FIG. 3, for attaching the corner B to a frame C.

Figure 9:
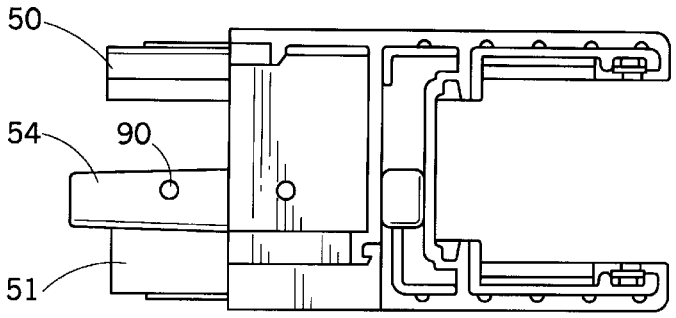
FIG. 9 is a top elevational view of the corner bracket.
Figure 7:
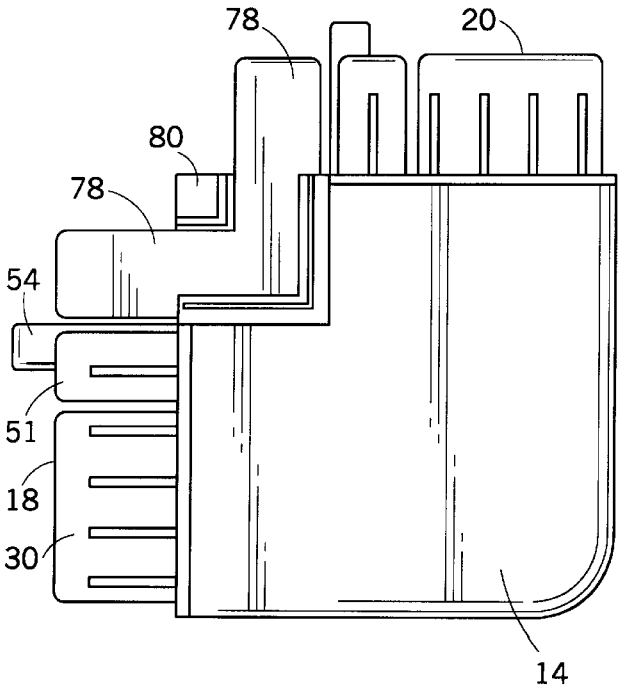
FIG. 7 is a side elevational view of the back side of the corner bracket.

The corner body 10 is further shown in side, front and top elevational views in FIGS. 7, 8, and 9, respectively.

As shown in FIG. 2, the corner bracket B is detachably received by a pair of frame members C.

Figure 5:
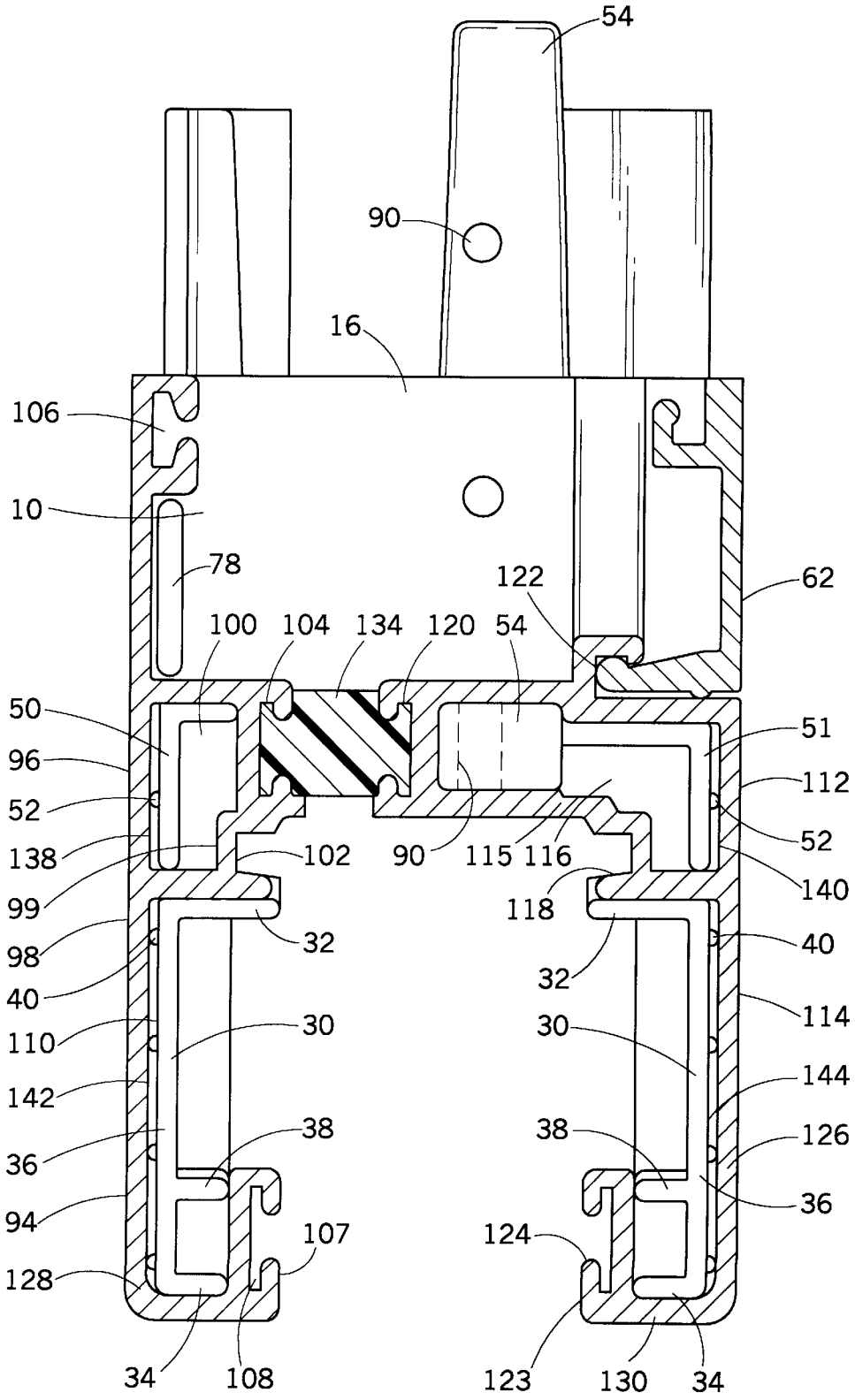
FIG. 5 is an enlarged front elevational view of the corner bracket and frame member in an assembled configuration with the frame member shown in cross section.

With reference now to FIG. 5, each frame member includes a body 94 having a first frame portion 96. The first frame portion 96 includes a front wall 98. The front wall 98 includes a first set of interconnected wall members 99 which extend from the front wall 98 to form an opening 100, a first groove 102, and a second groove 104. The front wall 98 can further include a third groove 106 located at the top of the front wall 98.

The front wall 98 further includes a second set of interconnecting wall members 107 which extend from the front wall 98 to form a fourth groove 108. The fourth groove 108 is spaced from the first, second and third grooves 102, 104, 106.

The first groove 102 and the fourth groove 108 engage a window or door track E which is shown in FIGS. 2 and 4. As shown in FIG. 3, the third groove 106 receives the weather insulation strip 82.

With reference again to FIG. 5, the front wall 98 can further include a first slot 110 formed between the first set of interconnecting wall members 99 and the second set of interconnecting wall members 107.

The frame members 94 can further include a second frame portion 112. The second frame portion 112 includes a rear wall 114. The rear wall 114 includes a first set of interconnected wall members 115 which extend from the rear wall 114 to define a stepped opening 116, a first upper groove 118, a second upper groove 120, and a third upper groove 122.

The rear wall 114 can further include a second set of interconnected wall members 123 which extend from the rear wall 114 to define a lower groove 124. The lower groove 124 is spaced from the first, second, and third upper grooves 118, 120, 122.

The first upper groove 118 and the lower groove 124 engage a window or door track E shown in FIGS. 2 and 4. As shown in FIG. 3, the third upper groove 122 engages the securing wall 62 for securing the window D in place.

With reference again to FIG. 5, the rear wall 114 can further include a second slot 126 which is formed between the first set of interconnected wall members 115 and the second set of interconnected wall members 123.

The first frame portion 96 and the second frame portion 112 each further include end surfaces 128, 130 which abutingly engage the abutment surfaces 70, 72, 74 of the first end 18 and the second end 20 of the corner body 10, which are shown in FIG. 8.

As shown in FIG. 3, the second frame portion 112 can further include an aperture 132 which is aligned with the aperture 90 of the finger 54 of the corner body 10 to accommodate a fastener 92.

The first frame portion 96 and the second frame portion 112 can be connected by a connection means in the form of a suitably shaped weather insulation strip 134 which engages the second groove 104 of the first frame portion 96 and the second upper groove 120 of the second frame portion 112. While the first and second frame portions are preferably made of a suitable conventional metal, such as aluminum, the strip 134 is made of a conventional elastomeric material such as rubber to serve as a thermal break and retard heat conduction through the frame member C.

An insulation cushion 136 can be affixed to the top of the first frame portion 96 and the second frame portion 112 to provide insulation and protection to a window D resting on the top of the first frame portion 96 and the second frame portion 112.

Referring now to FIG. 5, in the assembled configuration the corner body 10 is detachably received by the frame member 94. L-shaped members 50, 51 of the corner body 10 are detachably received by the opening 100 of the first frame portion 96 and the stepped opening 116 of the second frame portion 112, respectively. Ribs 52 on the L-shaped members 50, 51 contact inner walls 138, 140 of the openings 100, 116, respectively.

The channels 30 of the corner body 10 are detachably received by the first slot 110 of the first frame portion 96 and the second slot 126 of the second frame portion 112. Ribs 40 on the channels 30 contact inner walls 142, 144 of the slots 110, 126, respectively, to retard movement therebetween.

The finger 54 of the corner body 10 is detachably received by the stepped opening 116 of the second frame portion 112.

The protrusion 78 of the front side 12 of the corner body 10 is detachably received behind the front wall 98 of the first frame portion 96 between the third groove 106 and the first set of interconnected wall members 99.

It should be appreciated that a corner bracket according to the present invention can be used to connect structural frame members of doors, windows and other wall elements. Such doors or windows can be sliding or fixed. In addition, while the corner bracket of the present invention is shown as being used on a transparent door, the frame members connected by the corner member could just as easily hold a non-transparent door panel.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

Having thus described the present invention, it is now claimed:

1. A corner assembly for a door or window, the corner assembly comprising:

a frame member, said frame member comprising a wall including an opening therein; and a corner bracket comprising:

a body having a front side, a back side and a connecting wall extending therebetween, said body further comprising a first end and a second end, said second end extending approximately normal to said first end, said first end and said second end each comprising:

a pair of spaced channels which are oriented so as to face each other, said channels extending, respectively, from said front side and said back side of said body, said channels each comprising first and second side walls and a base wall connecting said first and second side walls, a pair of spaced L-shaped members which are oriented so as to face each other, said L-shaped members extending, respectively, from said front side and said back side of said body, said L-shaped members being spaced from said pair of channels, and a finger, said finger extending from said connecting wall, said finger being detachably received in said opening of said frame member wall.

2. The corner bracket of claim 1 wherein said connecting wall further comprises a groove portion, said groove portion comprising an arm and a flange depending from a free end of said arm.

3. The corner bracket of claim 1 wherein said front side and said back side each further comprise a first abutment surface and a second abutment surface, said first abutment surface being located on an outside surface of said base wall of said channels, said second abutment surface being located on at least one of said side walls of said channels.

4. The corner bracket of claim 3 wherein said front side and said back side each further comprise a third abutment surface, said third abutment surface being located on an outside surface of said L-shaped members.

5. The corner bracket of claim 1 wherein said first end and said second end each further comprise a third channel extending below said connecting wall of said body, wherein said third channel is oriented substantially perpendicular to said pair of channels.

6. The corner bracket of claim 1 wherein said first end and said second end each include a protrusion extending from said front side.

7. The corner bracket of claim 1 wherein said channels further comprise at least one rib which engages the wall of the frame member.

8. The corner bracket of claim 1 wherein said body is a one piece member fabricated from plastic.

9. The corner bracket of claim 1 wherein said finger includes an aperture for accommodating an associated fastener.

10. A corner assembly for a door or a window, the assembly comprising:

a pair of frame members, said frame members each comprising:

a first frame portion comprising:

a front wall, a first set of interconnected wall members extending from said front wall, a second set of interconnected wall members extending from said front wall, said second set of interconnected wall members being spaced from said first set of interconnected wall members, and, a first slot defined between said first and second set of interconnected wall members;

a second frame portion comprising:

a rear wall, a first set of interconnected wall members extending from said rear wall, said first set of interconnected wall members defining a stepped opening, a second set of interconnected wall members extending from said rear wall, said second set of interconnected wall members being spaced from said first set of interconnected wall members, and, a second slot defined between said first and second set of interconnected wall members;

means for connecting said first and second frame portions together to form each of said frame members;

a corner bracket comprising a body having a front side, a back side and a connecting wall, said body further comprising a first end and a second end, said second end extending approximately normal to said first end, said first end and said second end each comprising:

a pair of spaced channels which are oriented so as to face each other, said channels extending, respectively, from said front side and said back side, said channels each comprising first and second side walls and a base wall connecting said first and second side walls, said channels being detachably received, respectively, in said first slot and said second slot; and, a finger, said finger extending from said connecting wall, said finger being detachably received in said stepped opening.

11. The corner assembly of claim 10 wherein said first set of interconnected wall members extending from said front wall define an opening, a first groove, and a second groove.

12. The corner assembly of claim 11 wherein said first frame portion further comprises a third groove, said third groove located atop said front wall.

13. The corner assembly of claim 12 wherein said second set of interconnected wall members extending from said front wall define a fourth groove.

14. The corner assembly of claim 13 wherein said first set of interconnected wall members extending from said rear wall further define a first upper groove, a second upper groove, and a third upper groove.

15. The corner assembly of claim 14 wherein said second set of interconnected wall members extending from said rear wall define a lower groove.

16. The corner assembly of claim 10 wherein said connecting wall further comprises a groove portion, said groove portion comprising an arm and a flange depending from a free end of said arm, wherein said groove portion engages an associated securing member.

17. The corner assembly of claim 10 wherein said front side and said back side each further comprise a first abutment surface and a second abutment surface, said first abutment surface being located on an outside surface of said base wall of said channels, said second abutment surface being located on at least one of said side walls of said channels.

18. The corner assembly of claim 11 further comprising a first L-shaped member, said first L-shaped member extending from one of said front side and said back side, said first L-shaped member being spaced from said channels and being detachably received in one of said opening and said stepped opening of said first and second frame portions.

19. The corner assembly of claim 18 further comprising a second L-shaped member, said second L-shaped member oriented as to face said first L-shaped member, said second L-shaped member extending from another of said front side and said back side, said second L-shaped member being spaced from said channels and being detachably received in another of said opening and said stepped opening of said first and second frame portions.

20. The corner assembly of claim 10 wherein said first end and said second end each include a protrusion extending from said front side which engages said front wall of said first frame portion.

21. The corner assembly of claim 14 further comprising a weather insulation strip engaging said second groove of said first frame portion and said second upper groove of said second frame portion thereby connecting said first frame portion and said second frame portion.

22. A corner assembly for a door or a window, the assembly comprising:

a pair of frame members, said frame members each comprising:

a front wall, a rear wall, a set of interconnected walls extending from one of said front wall and said rear wall and defining a first opening, a slot defined in one of said front wall and said rear wall and spaced from said opening and, a connecting means for connecting said front wall and said rear wall;

a corner bracket comprising:

a body having a front side, a back side and a connecting wall extending therebetween, said body further comprising a first end and a second end, said second end extending approximately normal to said first end, said first end and said second end each comprising:

a pair of spaced channels which are oriented so as to face each other, said channels extending, respectively, from said front side and said back side, said channels each comprising first and second side walls and a base wall connecting said first and second side walls, one of said channels being detachably received in said slot; and, a pair of spaced L-shaped members which are oriented so as to face each other, said L-shaped members being spaced from said pair of channels and extending, respectively, from said front side and said back side, one of said L-shaped members being detachably received in said first opening.

23. The corner assembly of claim 22 further comprising at least one groove defined in one of said front wall and said rear wall and spaced from said first opening.

24. The corner assembly of claim 22 wherein said set of interconnected walls further define a second opening in one of said front wall and said rear wall.

25. The corner assembly of claim 24 further comprising a finger, said finger extending from said connecting wall, said finger being detachably received in one of said first and second openings.

26. The corner assembly of claim 25 wherein a second slot is defined in one of said front wall and said rear wall and is spaced from said first and second openings.

27. The corner assembly of claim 22 wherein said connecting wall further comprises a groove portion, said groove portion comprising an arm and a flange depending from a free end of said arm, wherein said groove portion engages an associated securing member.

* * * * *